United States Patent [19]

Key, Jr. et al.

[11] 4,028,540

[45] June 7, 1977

[54] FLASHLIGHT MARKING IMPLEMENT

[76] Inventors: Columbus B. Key, Jr., 49 New York Ave. NW., Washington, D.C. 20001; Vincent M. Spaulding, 2914 W St. SE., Washington, D.C. 20020

[22] Filed: Nov. 11, 1975

[21] Appl. No.: 630,885

[52] U.S. Cl. ..... 240/6.46; 401/192

[51] Int. Cl.[2] ..... B43K 5/12; F21Y 33/00

[58] Field of Search ..... 401/192; 240/2.18, 6.46, 240/6.4 R, 2 MT

[56] References Cited

UNITED STATES PATENTS

| | | | |
|---|---|---|---|
| 1,451,654 | 4/1923 | Garcin | 240/6.46 UX |
| 1,516,647 | 11/1924 | Saunders | 240/6.46 UX |
| 1,950,789 | 3/1934 | Eells | 240/6.46 |
| 1,996,563 | 4/1935 | Billings | 240/6.46 |
| 2,052,501 | 8/1936 | Thornton | 240/6.46 |
| 2,261,320 | 11/1941 | Williams | 240/6.46 |
| 2,407,106 | 9/1946 | Shelly | 240/6.46 |
| 2,493,796 | 1/1950 | Williams | 240/6.46 |
| 3,502,859 | 3/1970 | Kochan | 240/6.46 |

FOREIGN PATENTS OR APPLICATIONS

| | | | |
|---|---|---|---|
| 381,658 | 7/1940 | Italy | 240/6.46 |
| 2,841 | 2/1891 | United Kingdom | 401/192 |

*Primary Examiner*—Donald A. Griffin
*Attorney, Agent, or Firm*—Clarence A. O'Brien; Harvey B. Jacobson

[57] ABSTRACT

A marking implement having a self-contained source of illumination arranged to project a beam of light encircling the marking point on a surface. Angular displacement of a switch actuator connects the illumination source to either an external source of electrical energy for prolonged energization or to internal batteries designed to provide electrical energy for shorter intervals. A plug-in device establishes the energizing circuit from the external source, by-passing the internal batteries.

9 Claims, 11 Drawing Figures

ON
OFF

FLASHLIGHT MARKING IMPLEMENT

This invention relates to marking implements such as mechanical pencils, ball point pens, drafting reservoir pens or the like provided with a self-contained source of illumination for illuminating the surface being marked.

Marking implements having a self-contained source of illumination for projecting a beam of light in encircling relation to the marking point on the surface being marked, are well known as disclosed for example in U.S. Pat. Nos. 2,225,405, 2,261,320, 2,407,106 and 3,604,917. Often, such prior marking devices project illuminating beams that cast shadows. Further, such prior marking devices have rather awkward facilities for turning on and off the source of illumination. Also, the availability of illumination from such prior marking devices is not always reliable.

It is therefore an important object of the present invention to provide a marking device having a self-contained source of illumination which avoids the aforementioned drawbacks of prior art marking implements insofar as the provision of illumination is concerned.

In accordance with the present invention, a marking implement having a replaceable pencil point, ball point pen point, or reservoir pen point also includes facilities for projecting a beam of light in close encircling relationship to the marking point as to avoid the casting of shadows. The light is projected from an incandescent bulb through a light conducting tube within which a marking point device is replaceably received. The lamp bulb is illuminated by electrical energy supplied from an internal battery source in response to angular displacement of a switch actuator. Alternatively, electrical energy may be supplied from an external source through a plug-in device which is operative to establish a battery bypass circuit.

These together with other objects and advantages which will become subsequently apparent reside in the details of construction and operation as more fully hereinafter described and claimed, reference being made to the accompanying drawings forming a part hereof, wherein like numerals refer to like parts throughout.

Figures 1, 2, 3, 4, 7:
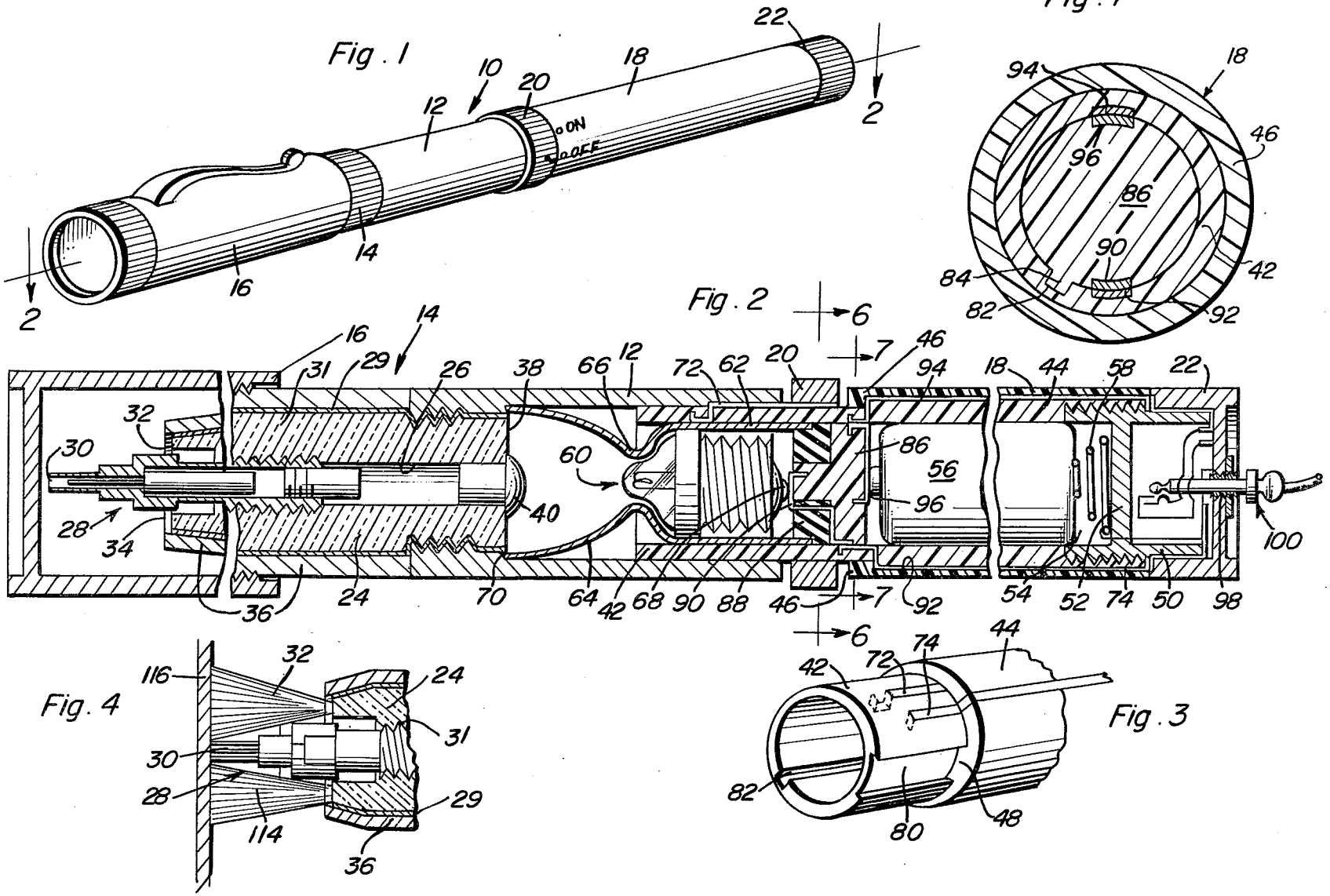
FIG. 1 is a perspective view showing a typical marking implement constructed in accordance with the present invention.
FIG. 2 is an enlarged partial sectional view taken substantially through a plane indicated by section line 2—2 in FIG. 1.
FIG. 3 is a perspective view of a portion of one of the parts associated with the implement shown in FIG. 2.
FIG. 4 is a partial side section view of the implement with the cover removed and showing the projection of a beam onto a marking surface.
FIG. 7 is a transverse sectional view taken substantially through a plane indicated by section line 7—7 in FIG. 2.

Referring now to the drawings in detail, FIG. 1 illustrates a typical marking implement constructed in accordance with the present invention and generally denoted by reference numeral 10. The implement includes a tubular body portion 12 made of a rigid, opaque material to which a tip portion 14 is replaceably connected substantially enclosed within a tubular cover 16. Connected to the tubular body 12 in coaxial relationship thereto is a tubular shell 18 that is axially spaced from the tubular body 12 by an angularly displaceable switch actuator ring 20. The end of the tubular shell 18 opposite the switch actuator 20, is closed by a removable cap 22.

As more clearly seen in FIG. 2, the tubular cover 16 is threadedly mounted on the tip portion 14 which encloses an axially elongated light conducting body 24 having a central bore 26 formed therein within which a marking device in the form of a reservoir pen 28 is mounted. The peripheral surface of the light conductive body 24 is provided with a coating or covering of light reflective material 29 such as reflective paint, aluminum foil or the like. The reflective surface could be placed on the interior of tip portion 36. It should of course be appreciated that other types of marking cartridges could be mounted within the light conducting body 24 such as mechanical lead pencils, mechanical drafting pencils, and ball point pen cartridges. The marking point 30 associated with the reservoir pen 28 thus projects forwardly from a light emitting face 32 of the light conducting body 24 which is closely spaced inwardly from the front axial end 34 of an opaque tubular shell 36. The rear light receiving end face 38 of the light conducting body 24 projects axially from the rear end of the tubular shell 36 into the tubular body 12. The central bore 26 at the rear end face 38 of the light conducting body 24 is closed by a plug 40. The reservoir pen point 30 is screwed into the light emitting end of the light conductive body 24 as at 31. The bore 26 in body 24 serves as an ink reservoir with the plug 40 closing one end of the bore and the reservoir pen point 30 closing the other end of the ink reservoir. The body 24 and thus the ink reservoir is of one-piece or monolithic construction from clear glass, plastic or similar transparent or translucent material. The plug 40 may be integral with the body 24 with the bore 26 being formed in the body when molded or cast or formed therein by drilling a blind bore. The screw threaded connection 31 is a standard thread used on conventional reservoir pens such as "Staedtler" or "Koenor" or the like which are available in engineering drafting supply stores.

The tubular body 12 is connected to a small diameter, tubular end portion 42 of a tubular housing 44 made of an electrically non-conductive material such as plastic. The tubular shell 18 also made of an electrically non-conductive material, encircles the tubular housing 44 and is provided at one axial end with a radially inwardly projecting enlargement 46 abutting the shoulder 48 (FIG. 3) between the housing 44 and its end portion 42. The switch actuator ring 20 is positioned between the enlargement 46 of the tubular shell 18 and the rear axial end of the tubular body 12. The rear end porton of the tubular body 44 is internally threaded for connection to a non-conductive tubular section 50 having a partition web 52 therein forming the end of an internal battery chamber 54 extending through the tubular body 44. A plurality of batteries 56 are accordingly positioned within the housing 44 and are held in series contact relationship to each other by a conical spring 58 between the rearmost battery casing and the partition web 52 of the tubular section 50. The forward terminal of the forwardmost battery 56 electrically contacts one terminal of an incandescent, threaded based bulb 60. The bulb 60 is positioned in the end portion 42 of the tubular housing within a tubular sleeve 62 made of an electrically conductive material. The sleeve 62 is interconnected with a reflector 64 into which the bulb 60 projects, the reflector 64 being interconnected with the sleeve 62 by a neck portion 66 by means of which the bulb is positioned by axial pressure applied to its filament terminal 68. The other filament terminal of the bulb is connected to a threaded base which is in electrical contact with the sleeve 62. The forward end of the reflector 64 abuts an internal shoulder 70 formed in the tubular body 12 in coplanar relationship to the light receiving face 38 of the light conducting body 24.

Figures 5, 6, 8, 9, 10, 11:
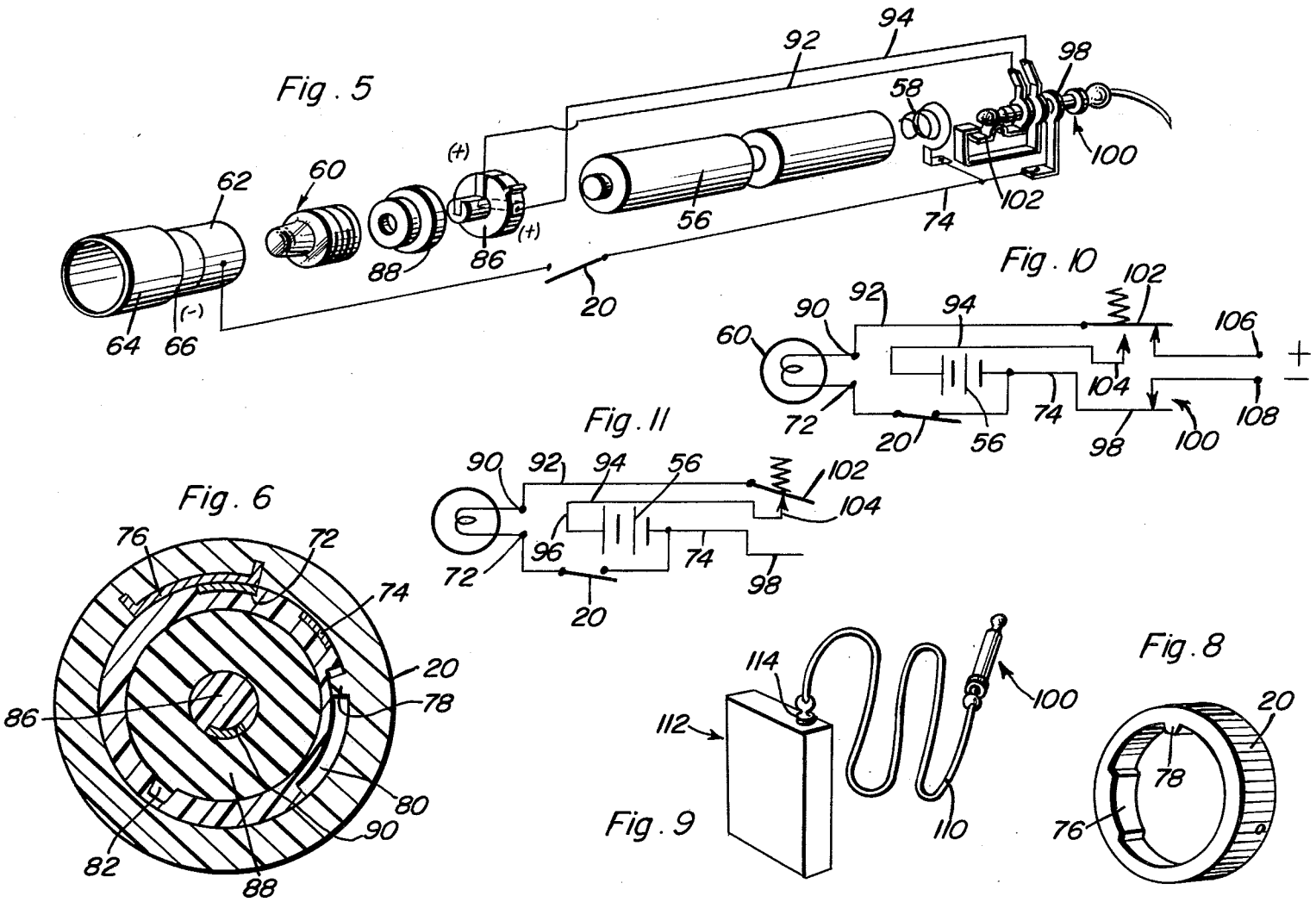
FIG. 5 is a perspective view showing various disassembled parts of the implement shown in FIG. 2.
FIG. 6 is a transverse sectional view taken substantially through a plane indicated by section line 6—6 in FIG. 2.
FIG. 8 is a perspective view of the disassembled switch actuator.
FIG. 9 is a perspective view of a typical external battery source of electrical energy to be utilized with the present invention.
FIG. 10 is an electrical circuit diagram illustrating the energizing for the source of illumination powered by an external source of electrical energy.
FIG. 11 is an electrical circuit diagram showing the energizing circuit powered by an external battery source.

As shown in FIGS. 2 and 3, an electrically conductive strip 72 is externally mounted on the tubular housing 44 and projects radially inwardly through the tubular portion 42 into contact with the conductive sleeve 62 to establish an electrical connection with one of the filament terminals of the bulb device 60. Another conductive strip 74 is externally mounted on the tubular end portion 42 of the tubular housing 44 and extends rearwardly along the external surface of the tubular housings 44 into the end cap 22 that is secured to the rear tubular section 50. The conductive strips 72 and 74 are circumferentially spaced on the external surface of the tubular end portion 42 of the housing 44 so as to be bridged by a bridging contact 76 internally mounted within the switch actuator ring 20 as shown in FIGS. 6 and 8. Accordingly, when the switch actuator ring 20 is angularly displaced from the "off" position illustrated to the "on" position, in a clockwise direction as viewed in FIG. 6, the conductive strips 72 and 74 will be bridged in order to establish an electrical connection from one filament terminal of the bulb device 60 to a negative power terminal as will be explained hereafter. Actuation of the switch in this fashion, completes an energizing circuit for illumination of the bulb 60. The switch actuator 20 is limited in its angular displacement from the off position to the on position by a limit stop projection 78 received within an arcuate notch 80 formed in the tubular end portion 42 of the housing.

Internally formed within the tubular end portion 42 of the housing as more clearly seen in FIGS. 3 and 7, is an axially extending alignment groove 82 receiving a projection 84 on an adapter 86 made of an electrically non-conductive material. The adapter mounts an annular insulating spacer 88 as shown in FIGS. 2 and 6 which abuts the rear end of the bulb retaining sleeve 62 to insulate it from the adapter 86 and the contacts carried thereon. A contact strip 90 is mounted on the adapter 86 for engagement by the filament terminal 68 of the bulb device. This contact strip is in engagement with the contacting end portion of a conductive strip 92 externally mounted on the tubular housing 44 and enclosed within the tubular shell 18. Another conductive strip 94 is externally mounted on the tubular housing 44 in circumferentially spaced relationship to the conductive strips 92 and 94 for contact as its forward end with a contact strip 96 mounted on the rear face of the adapter 86 for contact with the forwardmost terminal of the batteries 56. Thus, the conductive strips 92 and 94 are respectively connected electrically to a terminal of the bulb device 60 and a positive terminal of the batteries 56.

With continued reference to FIG. 2, the conductive strip 74 is electrically connected to an electrically conductive threaded sleeve 98 into which a plug device 100 is adapted to be inserted. When inserted, the outer sleeve of the plug device 100 will be electrically connected to the conductive strip 74 through the sleeve 98. Also, when the plug device 100 is inserted, it displaces contact 102 enclosed within the tubular section 50 from engagement with contact 104. The contacts 102 and 104 are respectively connected to the rear ends of the conductive strips 92 and 94. Further, the displaceable contact 102 which is spring-biased into engagement with contact 104 upon removal of the plug-in device 100, establishes electrical contact with an inner conductor of the plug-in device adapted to be connected to the positive terminal of an external source of electrical energy, the other conductor extending from the plug-in device being connected to the negative terminal of the external source.

As shown in FIG. 10, when the plug-in device 100 is inserted to open the contacts 102 and 104, an electrical circuit is established between the positive and negative power terminals 106 and 108 of an external source of electrical energy thereby completing an energizing circuit through the bulb device 60 upon closing of the switch 20, bypassing the batteries 56. Upon removal of the plug-in device 100 however, as shown in FIG. 11, the contacts 102 and 104 engage in order to interconnect one filament terminal of the bulb device 60 with the positive terminal of the batteries 56 to thereby complete an energizing circuit across the batteries upon closing of the switch 20. The contacts 102 and 104 thus interconnect the conductive strips 92 and 94 in order to interconnect the positive terminal of the batteries to one bulb filament, the other bulb filament being interconnected with the negative terminal of the battery upon closing of the switch 20. The conductive strip 74 as shown in FIG. 11, will then be inactive.

As shown in FIG. 9, the plug-in device 100 may be electrically connected through a power connecting cable 110 to an external battery pack 112 through another plug-in device 114. Alternatively, the plug-in device 100 may connect the marking implement to a voltage reducing rectifier adapted to be plugged into the usually available AC source of supply. When the marking implement is energized, light emitted by the bulb 60 will be transmitted through the light transmitting body 24 from the light receiving end face 38 to the light emitting face 32, from which an annular beam 114 is projected as shown in FIG. 4 onto a surface 116 to be marked. The point 30 of the pen 28 is spaced from the light emitting face 32 an optimum distance so that the light beam 114 will be projected in close encircling relationship to the marking tip or point 30 in order to avoid the casting of any shadows. The inwardly facing reflective surface 29 on the body 24 serves to increase the brilliancy of the light beam 114 cast onto surface 116.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An implement comprising an elongated tubular body having a source of illumination mounted therein, an internal source of electrical energy, energizing circuit means for conducting electrical energy from the internal source to the source of illumination, said tubular body including a tubular section and a light conducting body enclosing the source of illumination, a tubular housing projecting into the tubular section and mounting the circuit means therein, a protective shell enclosing the circuit means within the tubular housing in axially spaced relation to the tubular section, and switch means mounted on the tubular housing axially between the tubular section and the protective shell for selectively connecting said internal source to the circuit means.

2. The combination of claim 1 including an end cap secured to the tubular housing, a plug-in coupling connected to an external source of electrical energy and by-pass means connected to the circuit means and engageable by the coupling for conducting energy from the external source in by-pass relation to the internal source in response to insertion of the plug-in coupling into the end cap.

3. The combination of claim 1 wherein said circuit means includes an insulating spacer axially spacing the source of illumination from the internal source, conductor elements carried by the tubular housing, and electrical connector means mounted by the spacer for electrically connecting the source of illumination and internal source to the conductor elements.

4. The combination of claim 1 wherein said switch means comprises an annular actuator, and a bridging contact element internally mounted therein for connecting the source of illumination to one of the conductor elements.

5. A marking implement including an elongated tubular body having a source of illumination mounted therein, an internal source of electrical energy, energizing circuit means mounted within the tubular body for conducting electrical energy from the internal source to the source of illumination, a plug-in coupling connected to an external source of electrical energy and by-pass contact means connected to the circuit means and engageable by the coupling for conducting energy from the external source in by-pass relation to the internal source in response to insertion of the plug-in coupling into the tubular body, said tubular body including a tubular section and a light conducting body enclosing the source of illumination, a tubular housing projecting into the tubular section and mounting the circuit means therein, a protective shell enclosing the circuit means within the tubular housing in axially spaced relation to the tubular section, an end cap secured to the tubular housing and enclosing the by-pass contact means, and switch means mounted on the tubular housing axially between the tubular section and the protective shell for connecting the source of illumination to the circuit means.

6. The combination of claim 5 wherein said switch means comprises an annular actuator, and a bridging contact element internally mounted therein for connecting the source of illumination to the internal source.

7. The combination of claim 5 wherein said circuit means includes an insulating spacer axially spacing the source of illumination from the internal source, conductor elements carried by the tubular housing and connected to the by-pass contact means, and electrical connector means mounted by the spacer for electrically connecting the source of illumination and internal source to the conductor elements.

8. An illumination implement comprising an elongated tubular body having a light emitting end section and an opposite end section enclosing a source of illumination, a housing having a tubular end portion projecting into the opposite end section of the tubular body and a protective portion enclosing an internal source of electrical energy in axially spaced relation to the tubular body, energizing circuit means carried on the housing for conducting electrical energy from said internal source to the source of illumination, and switch means mounted on the tubular end portion of the housing axially between the tubular body and the protective portion of the housing for selectively connecting the internal source to the source of illumination through the circuit means.

9. The combination of claim 8, wherein said switch means includes an annular actuator, and a bridging contactor internally mounted therein in wiping contact with the circuit means.

* * * * *